US006293403B1

(12) United States Patent
Holmberg

(10) Patent No.: US 6,293,403 B1
(45) **Date of Patent: *Sep. 25, 2001**

(54) VITAMIN ORGANIZING, STORING AND DISPENSING SYSTEM

(76) Inventor: Doublas A. Holmberg, 1321 N. Valrico Rd., Valrico, FL (US) 33954

( * ) Notice: Subject to any disclaimer, the term of this patent is extended or adjusted under 35 U.S.C. 154(b) by 0 days.

This patent is subject to a terminal disclaimer.

(21) Appl. No.: 09/536,011

(22) Filed: Mar. 26, 2000

Related U.S. Application Data

(63) Continuation of application No. 09/247,372, filed on Feb. 10, 1999, now Pat. No. 6,041,932.

(51) Int. Cl.[7] ..... B65D 83/04
(52) U.S. Cl. ..... 206/534; 206/459.5
(58) Field of Search ..... 206/530, 534, 206/538, 539, 459.5, 528; 383/37–39

(56) References Cited

U.S. PATENT DOCUMENTS 4,318,477 * 3/1982 Kerpe ..... 206/534
4,593,819 * 6/1986 Will ..... 206/534
4,749,085 * 6/1988 Denney ..... 206/534
4,811,845 * 3/1989 Baggett ..... 206/534
4,972,657 * 11/1990 McKee ..... 206/534
5,788,079 * 8/1998 Bouthiette ..... 206/534
5,788,974 * 8/1998 D'Amico et al. ..... 206/438

* cited by examiner

*Primary Examiner*—Luan K. Bui
(74) *Attorney, Agent, or Firm*—Arthur W. Fisher, III

(57) ABSTRACT

A system to organize, store and dispense a plurality of tablets in a predetermined theraputic regime comprising a plurality of sets of separate packets corresponding to the days of the week or the dates of the month configured to store at least one tablet therein wherein each set of separate packets comprises a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date.

4 Claims, 7 Drawing Sheets

VITAMIN ORGANIZING, STORING AND DISPENSING SYSTEM

This is a continuation application of Ser. No. 09/247,372; filed Feb. 10, 1999 issued as U.S. Pat. No. 6,041,932.

BACKGROUND OF THE INVENTION

1. Field of the Invention

A system to organize, store and dispense a plurality of tablets in a predetermined theraputic regime.

2. Description of the Prior Art

The treatment of various medical disorders often involves a complex therapeutic regimen where the patient is required to take medications on specific days and times of day. The patient may be required to take a given medicament only at certain times in the regimen, and other medicaments at other times in the regimen. The compliment of such regimens often results in low patient compliance.

Furthermore, the misuse of prescribed drugs is a serious problem for persons who are easily confused, have short memories or are physically or mentally infirmed. The misuse of prescribed drugs is particularly evident among senior citizens. As a result, thousands of people die each year from failure to take medication at prescribed times or in proper dosages, from failure to follow other instructions relating to the medication, or from complications of side effects or adverse interaction of medications or drugs accidently or carelessly prescribed for and administered to the same patient.

U.S. Pat. No. 5,169,001 shows a container for a plurality of medicaments to be used in a therapeutic regimen for a patient to facilitate the prescribed sequence and interval of application. The container includes a plurality of generally planar blister cards having medicament containing cavities. Each blister card is adapted to contain a single medicament, and is provided with a marginal region for receiving medicament and administration indicia. The container is further provided with a base for retaining the plurality of blister cards in a generally vertical position with the marginal region of the blister cards extending upmost. The blister cards are retained in sequential arrangement by the prescribed time of day of administration of the medicament contained in each blister card.

U.S. Pat. No. 4,860,899 discloses an apparatus and articles for use in dispensing medication. Control of the medication is accomplished by assigning unique numerical (or alpha-numerical) code identifications to each of the many medications prescribed for patient use. A typical dosage, usually a unit dosage, of each medication is placed in a sealed packet and each packet is marked with the code identification of the medication contained in the packet.

U.S. Pat. No. 4,972,657 relates to a method, system and related apparatus and articles for use in dispensing medication. Control of the medication is accomplished by assigning unique numerical or alpha-numerical code identifications to each of the many medications prescribed for patient use. The apparatus includes a set of individual envelopes which are produced in continuous web form, similar to multi-part business forms, and which can be processed through computer controlled printers.

U.S. Pat. No. 4,473,156 teaches an apparatus for accurately selecting, storing and dispensing multiple varieties of pills at preselected time intervals such as morning, noon, evening and night includes a separate pill container for each unique variety of pill to be dispensed. Each pill container is identified by a distinctive color or colors to indicate the time interval(s) during which the pill in it are to be dispensed. For example, each container for pills to be dispensed in the morning will be identified by the color red; at noon, by the color yellow; in the evening, the color blue; and at night the color black. Any particular container will, therefore, be identified by color. A pill tray includes a plurality of pill holding compartments arranged in columns identified with each of the days of the week and in rows, each row representing one of the time intervals, such as morning, noon, evening and night. Each pill holding compartment in the row representing morning is colored red, the row representing noon is colored yellow, the evening row is colored blue, and the night row is colored black. The tray is loaded by putting one pill from each container in each of the compartments colored the same as one of the colors identifying that container. Sliding panels are provided as covers for each of the columns, and the patient can access the proper medication by uncovering the appropriate compartment at the appropriate time interval. For example, on Monday morning, the patient slides the "Monday" panel down far enough to uncover the Monday morning compartment, removes the pills and ingests them.

The following are additional examples of the prior art: U.S. Pat. No. 5,050,739; U.S. 5,029,726; U.S. 4,811,845; U.S. 4,749,085; U.S. 4,793,492; U.S. 4,593,819; U.S. 4,573,580; U.S. 4,318,477; U.S. 5,064,071; U.S. 5,390,796; GB 2 250 978 A; WO 92/02202; and GB 2 079 250 A.

SUMMARY OF THE INVENTION

The present Invention relates to a system to organize, store and dispense a plurality of tablets in a predetermined theraputic regime comprising a plurality of sets of separate packets corresponding to the days of the week or the dates of the month configured to store at least one tablet therein wherein each set of separate packets includes a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date. The packets may comprise resealable, flexible transparent envelopes each including a day or date indicator and a time of day or date indicator; while, the packet organizer may comprise a tray or panel including a day or date indicator and a time or day or date indicator corresponding to the day or date indicator and the time of day or date indicator of the packets to receive or support the corresponding packets thereon. A childproof or safety container may be used in place of the packets as described.

The plurality of sets of separate packets comprises a plurality of sets of packets each including a discrete set indicia and subset indicia formed thereon.

The set indicia on the packets may comprise an alpha indicator such as Monday or MON, Tuesady or TUES, Wednesday or WED, Thursday or THUR, Friday or FRI, Saturday or SAT, Sunday or SUN, a numeric indicator such as 1st, 2nd, 3rd, 4th, 5th, 6th, 7th, discrete differentiating color indicators, discrete differentiating braille indicators or other such differentiating indicators.

The indicia on the subset packets may comprise an alpha indicator such as AM, NN (noon), PM and BT (bedtime), discrete differentiating color indicators such as green, black, blue and red respectively, discrete differentiating braille indicators or other such differentiating indicators.

The packet organizer or tray has a plurality of packet compartments formed in columns and rows each including a set indicia and a subset indicia formed thereon.

The set indicia on the packet compartments may comprise an alpha indicator such as Monday or MON, Tuesady or TUES, Wednesday or WED, Thursday or THUR, Friday or FRI, Saturday or SAT, Sunday or SUN, a numeric indicator such as 1st, 2nd, 3rd, 4th, 5th, 6th, 7th, discrete differentiating color indicators, discrete differentiating braille indicators or other such differentiating indicators.

The indicia on the subset packet compartments may comprise an alpha indicator such as AM, NN (noon), PM and BT (bedtime), discrete differentiating color indicators such as green, black, blue and red respectively, discrete differentiating braille indicators or other such differentiating indicators.

In use, tablets from bottles or containers are placed into the appropriate packets with the sets and subsets in accordance with the required or dictated usage. The sets and subsets of the packets are then matched with corresponding indicia of the tray. Once organized and stored with corresponding indicia as a means or guide to match the packets with the corresponding packet compartments, the system will provide a convenient and reliable means for dispensing tablets at the appropriate time on the appropriate day or date.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
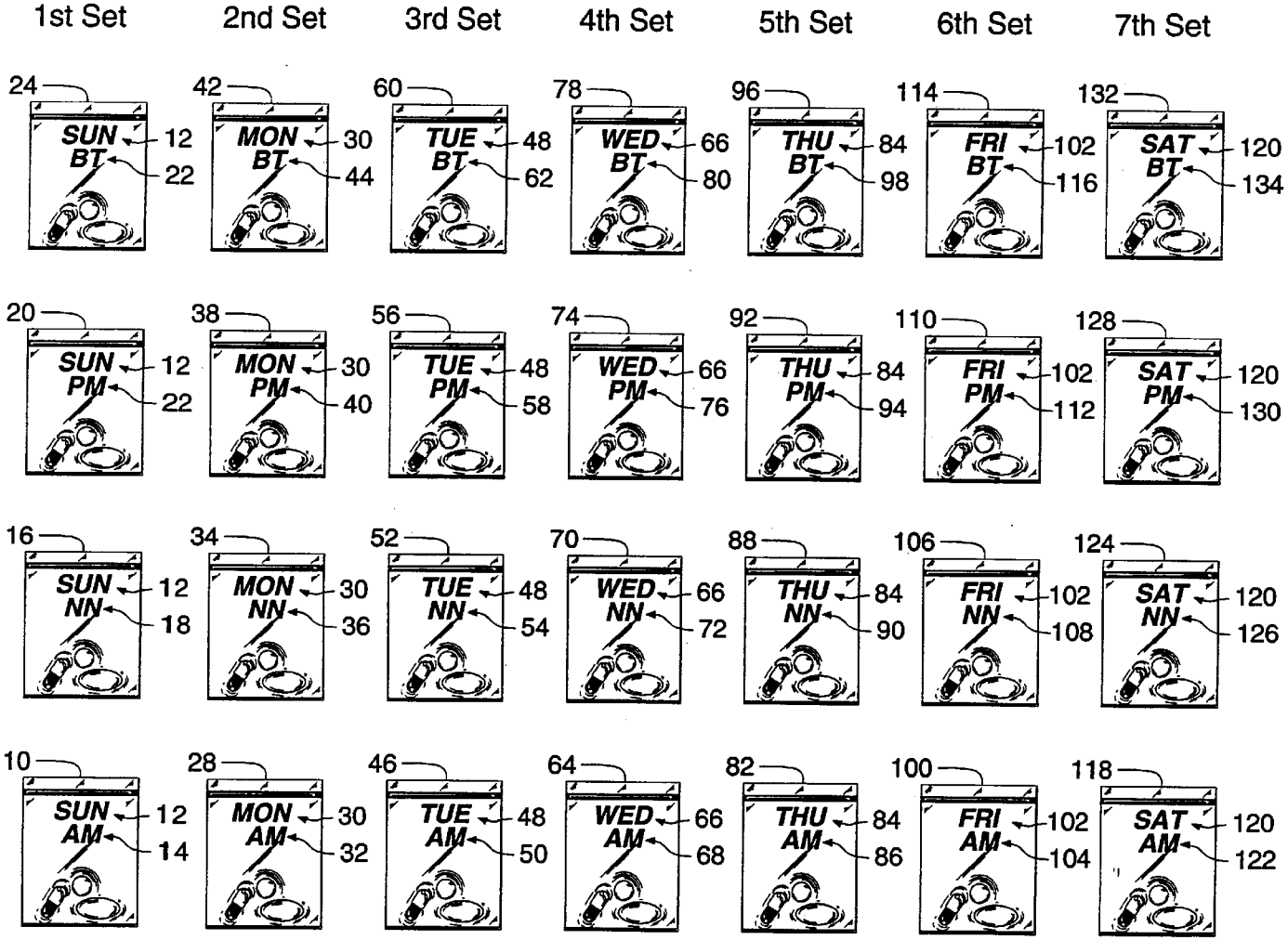
FIG. 1 is a front view of the sets and subsets of packets of the system to organize, store and dispense a plurality of tablets of the present invention.

The present invention relates to a system to organize, store and dispense a plurality of tablets in a predetermined theraputic regime. The term "tablet or tablets" as used herein refers to tablet or tablets, pill or pills, capsule or capsules and other such individually administered medicinal or theraputic dosages.

The system of the present invention comprises a system to organize, store and dispense a plurality of tablets in a predetermined theraputic regime comprising a plurality of sets of separate packets corresponding to the days of the week or the dates of the month configured to store at least one tablet therein wherein each set of separate packets comprises a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date. The packets may comprise resealable, flexible transparent envelopes each including a day or date indicator and a time of day or date indicator; while, the packet organizer may comprise a tray or panel including a day or date indicator and a time or day or date indicator corresponding to the day or date indicator and the time of day or date indicator of the packets to receive or support the corresponding packets thereon. A childproof or safety container may be used in place of the packets as described.

As shown in FIGS. 1, 4, 6 and 7, the plurality of sets of separate packets comprises a first set of packets including a first subset packet 10 having a first set indicia 12 and a first subset indicia 14 formed thereon, a second subset packet 16 having the first set indicia 12 and a second subset indicia 18 formed thereon, a third subset packet 20 having the first set indicia 12 and a third subset indicia 22 formed thereon and a fourth subset packet 24 having the first set indicia 12 and a fourth subset indicia 26 formed thereon; a second set of packets including a first subset packet 28 having a second set indicia 30 and a first subset indicia 32 formed thereon, a second subset packet 34 having the second set indicia 30 and a second subset indicia 36 formed thereon, a third subset packet 38 having the second set indicia 30 and a third subset indicia 40 formed thereon and a fourth subset packet 42 having the second set indicia 30 and a fourth subset indicia 44 formed thereon; a third set of packets including a first subset packet 46 having a third set indicia 48 and a first subset indicia 50 formed thereon, a second subset packet 52 having the third set indicia 48 and a second subset indicia 54 formed thereon, a third subset packet 56 having the third set indicia 48 and a third subset indicia 58 formed thereon and a fourth subset packet 60 having the third set indicia 48 and a fourth subset indicia 62 formed thereon; a fourth set of packets including a first subset packet 64 having a fourth set indicia 66 and a first subset indicia 68 formed thereon, a second subset packet 70 having the fourth set indicia 66 and a second subset indicia 72 formed thereon, a third subset packet 74 having the fourth set indicia 66 and a second subset indicia 76 formed thereon and a fourth subset packet 78 having the fourth set indicia 66 and a fourth subset indicia 80 formed thereon; a fifth set of packets including a first subset packet 82 having a fifth set indicia 84 and a first subset indicia 86 formed thereon, a second subset packet 88 having the fifth set indicia 84 and a second subset indicia 90 formed thereon, a third subset packet 92 having the fifth set indicia 84 and a third subset indicia 94 formed thereon and a fourth subset packet 96 having the fifth set indicia 84 and a fourth subset indicia 98 formed thereon; a sixth set of packets including a first subset packet 100 having a sixth set indicia 102 and a first subset indicia 104 formed thereon, a second subset packet 106 having the sixth set indicia 102 and a second subset indicia 108 formed thereon, a third subset packet having the sixth set indicia 102 and a third subset indicia 112 formed thereon and a fourth subset packet 114 having the sixth set indicia 102 and a fourth subset indicia 116 formed thereon; and a seventh set of packets including a first subset packet 118 having a seventh set indicia 120 and a first subset indicia 122 formed thereon, a second subset packet 124 having the seventh set indicia 120 and a second subset indicia 126 formed thereon, a third subset packet 128 having the seventh set indicia 120 and a third subset indicia 130 formed thereon and a fourth subset packet 132 having the seventh set indicia 120 and a fourth subset indicia 134 formed thereon.

Figure 4:
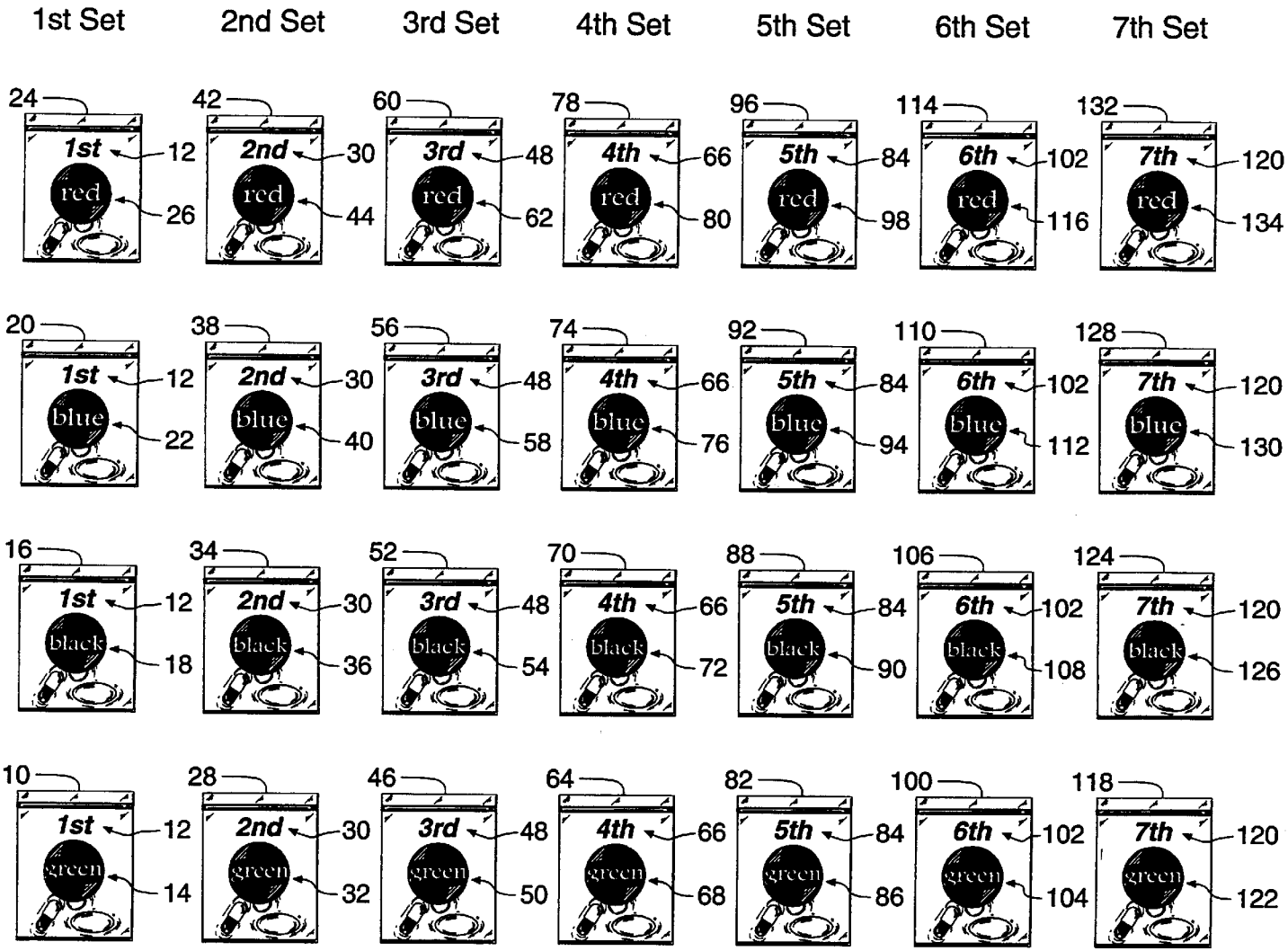
FIG. 4 is a front view of an alternate embodiment of the sets and subsets of packets of the system to organize, store and dispense a plurality of tablets of the present invention.
Figure 6:
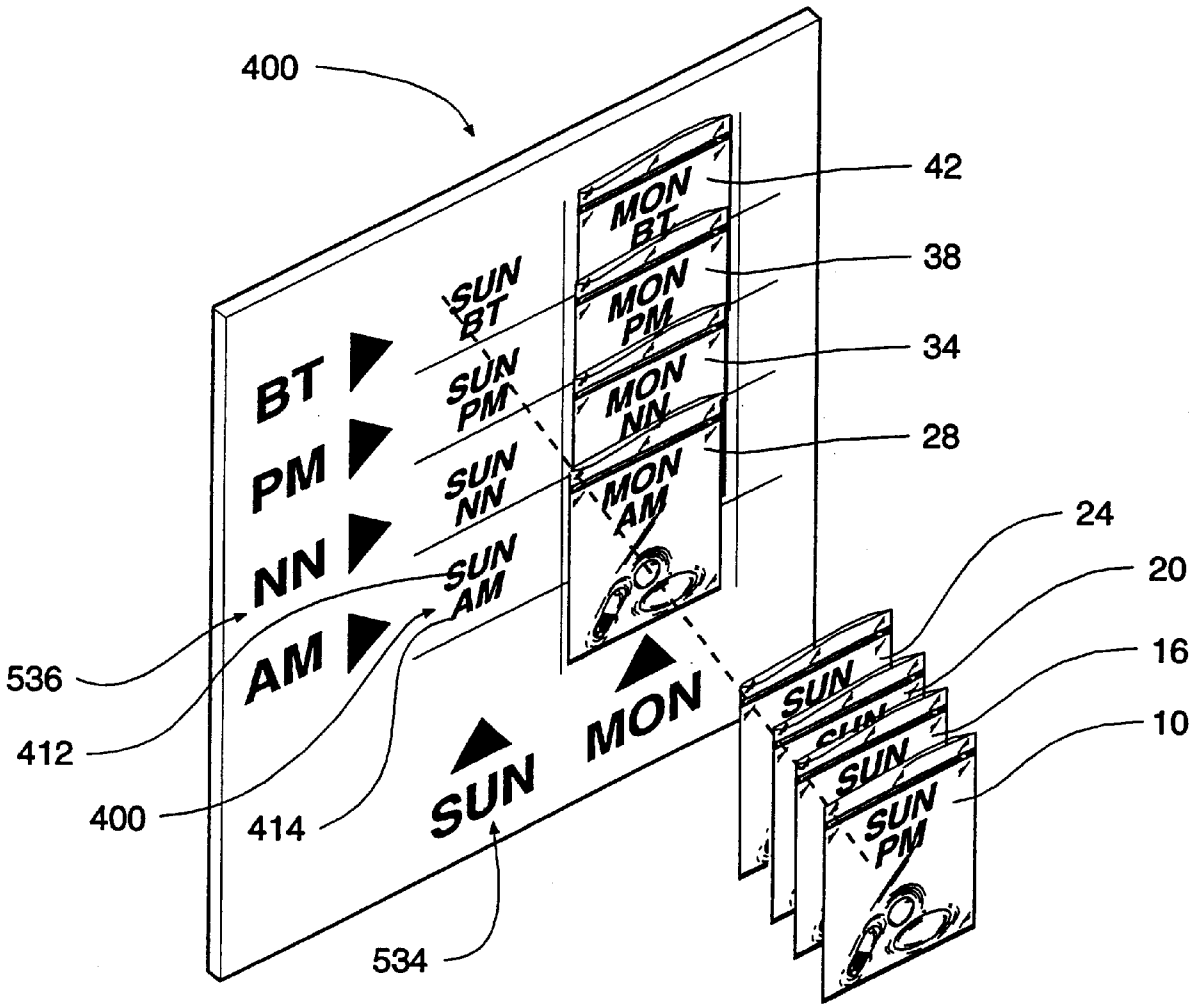
FIG. 6 is an exploded perspective view of the alternate embodiment of the system to organize, store and dispense a plurality of tablets of the present invention shown in FIG. 5.
Figure 7:
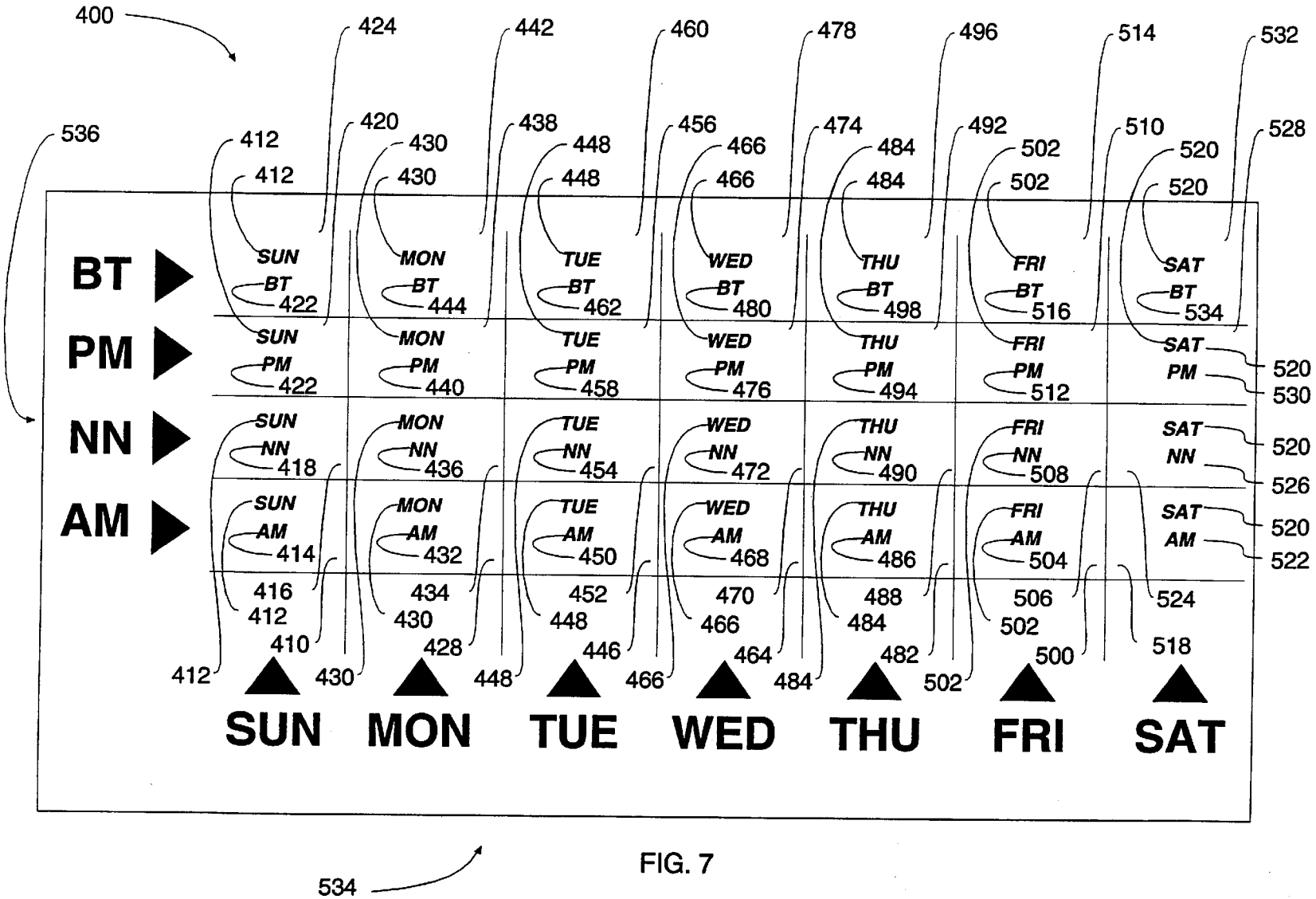
FIG. 7 is a front view of the packet organizer for the sets and subsets of packets of the alternate embodiment of the system to organize, store and dispense a plurality of tablets of the present invention shown in FIG. 6.

The indicia of the first set through the seventh set of packets may comprise an alpha indicator such as Monday or MON, Tuesday or TUES, Wednesday or WED, Thursday or THUR, Friday or FRI, Saturday or SAT, Sunday or SUN respectively (as shown in FIGS. 1, 6 and 7); a numeric indicator such as 1st, 2nd, 3rd, 4th, 5th, 6th, 7th respectively (as shown in FIG. 4); discrete differentiating color indicators, discrete differentiating braille indicators or other such differentiating indicators.

The indicia of first subset packets through the fourth subset packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively of each set of packets may comprise an alpha indicator such as AM, NN (noon), PM and BT (bedtime) respectively (as shown in FIGS. 1, 6 and 7), discrete differentiating color indicators such as green, black, blue and red respectively (as shown in FIG. 4), discrete differentiating braille indicators or other such differentiating indicators.

Figure 2:
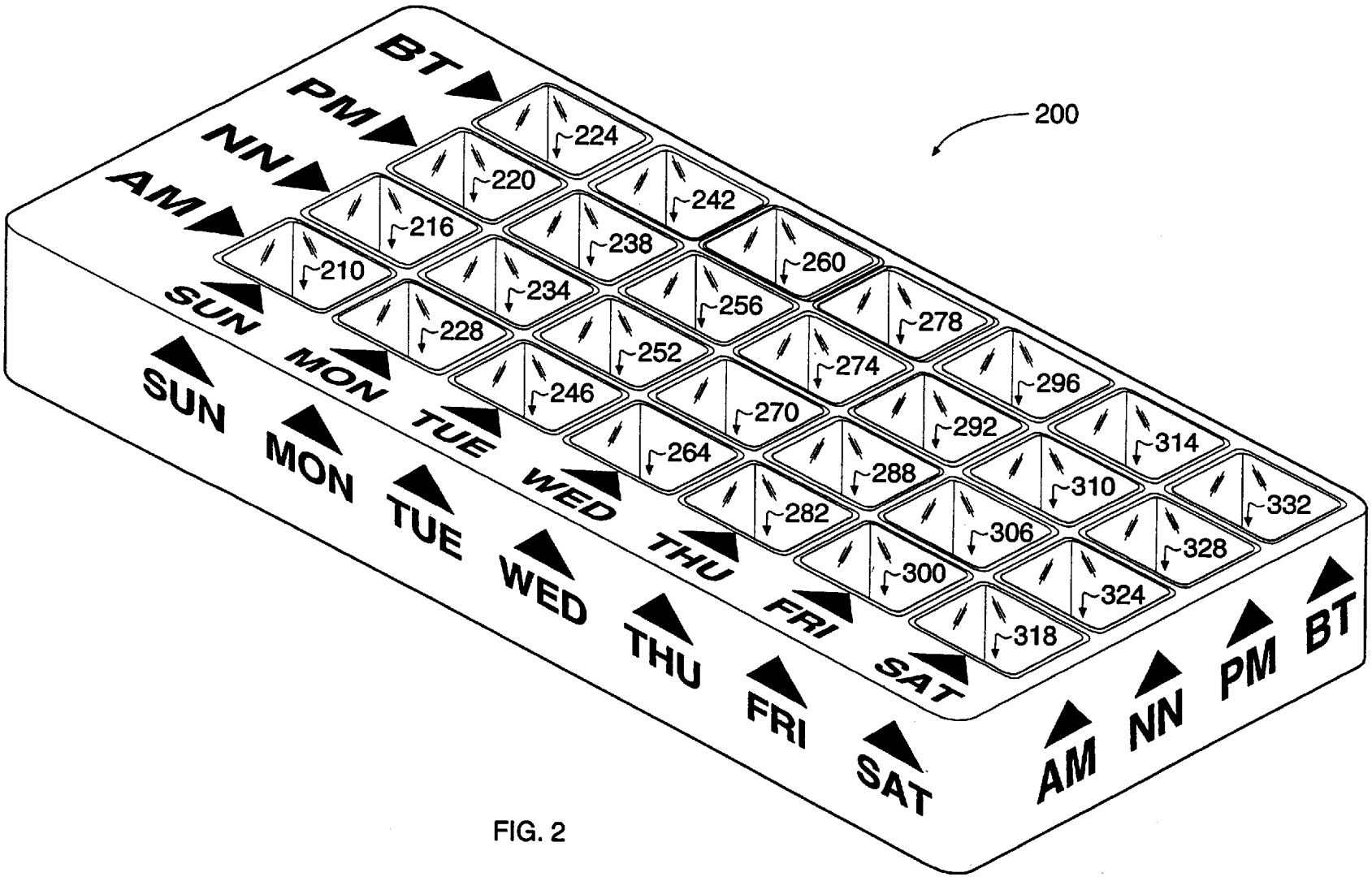
FIG. 2 is a perspective view of the packet organizer for the sets and subsets of packets of the system to organize, store and dispense a plurality of tablets.
Figure 3:
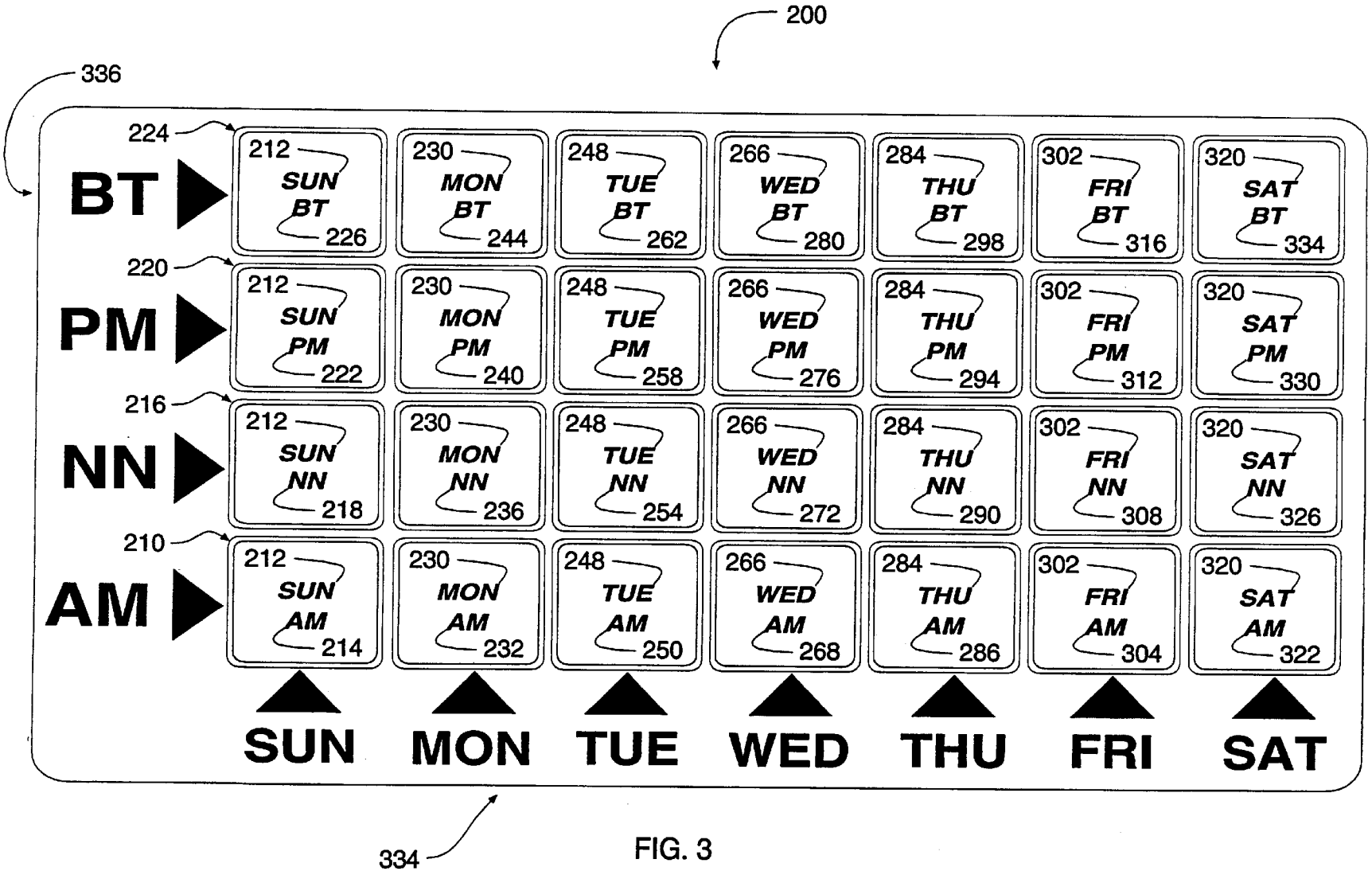
FIG. 3 is a top view of the packet organizer for the sets and subsets of packets of the system to organize, store and dispense a plurality of tablets of the present invention.

As shown in FIGS. 2 and 3, the packet organizer or tray generally indicated as 200 has a plurality of packet compartments formed in columns and rows comprising a first set of packet compartments including a first subset packet compartment 210 having a first set indicia 212 and a first subset indicia 214 formed thereon, a second subset packet compartment 216 having the first set indicia 212 and a second subset indicia 218 formed thereon, a third subset packet compartment 220 having the first set indicia 212 and a third subset indicia 222 formed thereon and a fourth subset packet compartment 224 having the first set indicia 212 and a fourth subset indicia 226 formed thereon; a second set of packet compartments including a first subset packet compartment 228 having a second set indicia 230 and a first subset indicia 232 formed thereon, a second subset packet compartment 234 having the second set indicia 230 and a second subset indicia 236 formed thereon, a third subset packet compartment 238 having the second set indicia 230 and a third subset indicia 240 formed thereon and a fourth subset packet compartment 242 having the second set indicia 230 and a fourth subset indicia 244 formed thereon; a third set of packet compartments including a first subset packet compartment 246 having a third set indicia 248 and a first subset indicia 250 formed thereon, a second subset packet compartment 252 having the third set indicia 248 and a second subset indicia 254 formed thereon, a third subset packet compartment 256 having the third set indicia 248 and a third subset indicia 258 formed thereon and a fourth subset packet compartment 260 having the third set indicia 248 and a fourth subset indicia 262 formed thereon; a fourth set of packet compartments including a first subset packet compartment 264 having a fourth set indicia 266 and a first subset indicia 268 formed thereon, a second subset packet compartment 270 having the fourth set indicia 266 and a second subset indicia 272 formed thereon, a third subset packet compartment 274 having the fourth set indicia 266 and a second subset indicia 276 formed thereon and a fourth subset packet compartment 278 having the fourth set indicia 266 and a fourth subset indicia 280 formed thereon; a fifth set of packet compartments including a first subset packet compartment 282 having a fifth set indicia 284 and a first subset indicia 286 formed thereon, a second subset packet compartment 288 having the fifth set indicia 284 and a second subset indicia 290 formed thereon, a third subset packet compartment 292 having the fifth set indicia 284 and a third subset indicia 294 formed thereon and a fourth subset packet compartment 296 having the fifth set indicia 284 and a fourth subset indicia 298 formed thereon; a sixth set of packet compartments including a first subset packet compartment 300 having a sixth set indicia 302 and a first subset indicia 304 formed thereon, a second subset packet compartment 306 having the sixth set indicia 302 and a second subset indicia 308 formed thereon, a third subset packet compartment 310 having the sixth set indicia 302 and a third subset indicia 312 formed thereon and a fourth subset packet compartment 314 having the sixth set indicia 302 and a fourth subset indicia 316 formed thereon; and a seventh set of packet compartments including a first subset packet compartment 318 having a seventh set indicia 320 and a first subset indicia 322 formed thereon, a second subset packet compartment 324 having the seventh set indicia 320 and a second subset indicia 326 formed thereon, a third subset packet compartment 328 having the seventh set indicia 320 and a third subset indicia 330 formed thereon and a fourth subset packet compartment 332 having the seventh set indicia 320 and a fourth subset indicia 334 formed thereon.

Figure 5:
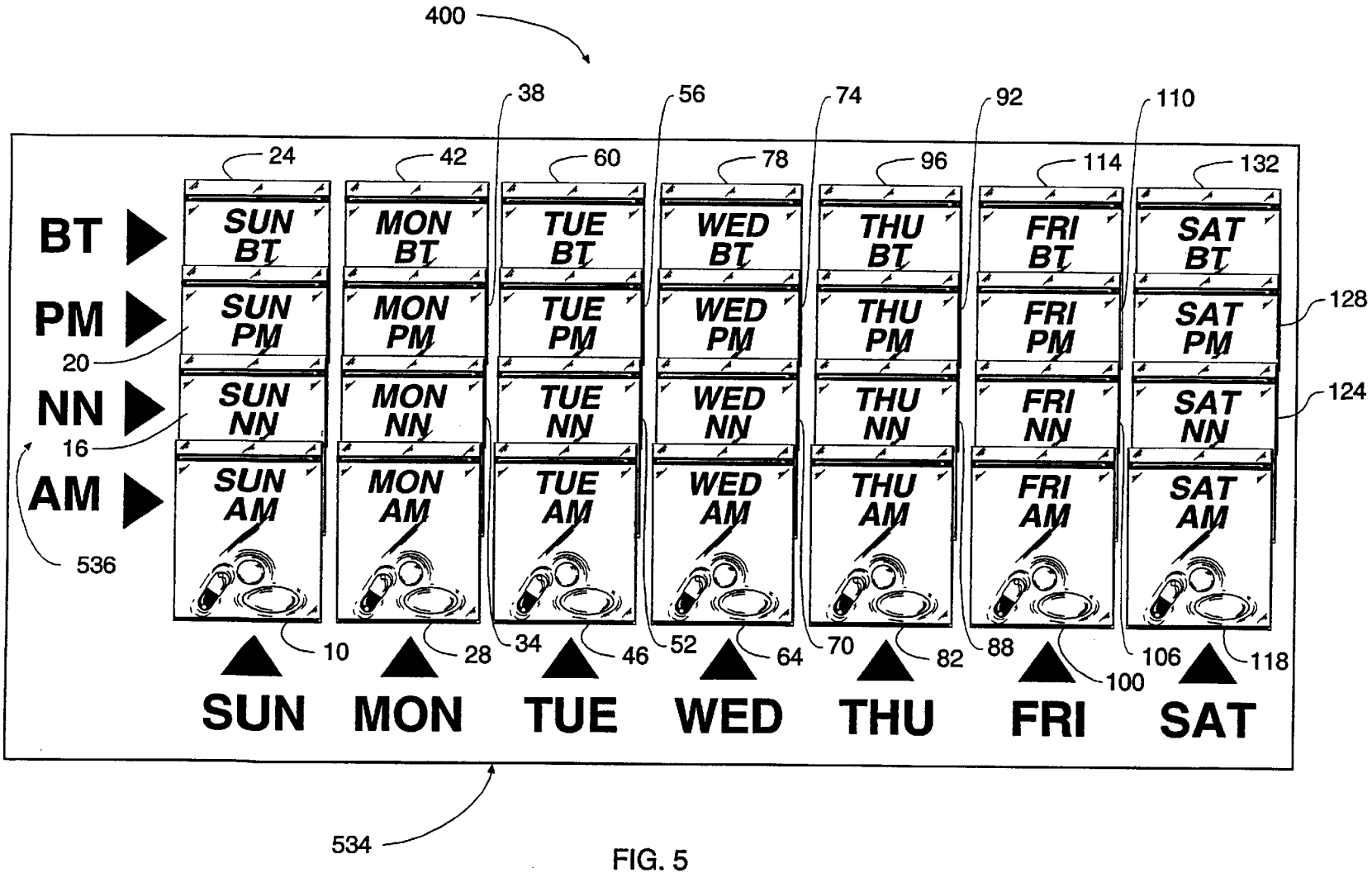
FIG. 5 is a front view of an alternate embodiment of the system to organize, store and dispense a plurality of tablets of the present invention.

The indicia of the first set through the seventh set of packet compartments may comprise an alpha indicator such as Monday or MON, Tuesday or TUES, Wednesday or WED, Thursday or THUR, Friday or FRI, Saturday or SAT, Sunday or SUN respectively (as shown in FIGS. 2 and 3); a numeric indicator such as 1st, 2nd, 3rd, 4th, 5th, 6th, 7th respectively (as shown in FIG. 5); discrete differentiating color indicators, discrete differentiating braille indicators or other such differentiating indicators.

The indicia of first subset packets through the fourth subset packet compartments 210, 228, 246, 264, 282, 300 and 318; 216, 234, 252, 270, 288, 306 and 324; 220, 238, 256, 274, 292, 310 and 328; and 224, 242, 260, 278, 296, 314 and 332 respectively of each set of packet compartments may comprise an alpha indicator such as AM, NN (noon), PM and BT (bedtime) respectively (as shown in FIGS. 2 and 3), discrete differentiating color indicators such as green, black, blue and red respectively (as shown in FIG. 5), discrete differentiating braille indicators or other such differentiating indicators.

In addition, the tray may include a set indicia generally indicated as 334 formed along the upper or lower border or periphey thereof and a subset indicia generally indicated as 336 formed along either side border or periphery thereof.

In use, tablets from bottles or containers are placed into the appropriate packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively with the sets and subsets in accordance with the required or dictated usage. The sets and subsets of the packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively are then matched with corresponding indicia of the tray 200 such that the packet 10 is placed in the packet compartment 210 and so forth for all the packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively. Once organized and stored with corresponding indicia as a means or guide to match the packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively with the corresponding packet compartments 210, 228, 246, 264, 282, 300 and 318; 216, 234, 252, 270, 288, 306 and 324; 220, 238, 256, 274, 292, 310 and 328; and 224, 242, 260, 278, 296, 314 and 332 respectively, the system will provide a convenient and reliable means for dispensing tablets at the appropriate time on the appropriate day or date.

As shown in FIGS. 6 and 7, the packet organizer or panel generally indicated as 400 has a plurality of packet positions formed in columns and rows comprising a first set of packet positions including a first subset packet position 410 having a first set indicia 412 and a first subset indicia 414 formed thereon, a second subset packet position 16 having the first set indicia 412 and a second subset indicia 418 formed thereon, a third subset packet position 420 having the first set indicia 412 and a third subset indicia 422 formed thereon and a fourth subset packet position 424 having the first set indicia 412 and a fourth subset indicia 426 formed thereon; a second set of packet positions including a first subset packet position 428 having a second set indicia 430 and a first subset indicia 432 formed thereon, a second subset packet position 434 having the second set indicia 430 and a second subset indicia 436 formed thereon, a third subset packet position 438 having the second set indicia 430 and a third subset indicia 440 formed thereon and a fourth subset packet position 442 having the second set indicia 430 and a fourth subset indicia 444 formed thereon; a third set of packet positions including a first subset packet position 446 having a third set indicia 448 and a first subset indicia 450 formed thereon, a second subset packet position 452 having the third set indicia 448 and a second subset indicia 454 formed thereon, a third subset packet position 456 having the third set indicia 448 and a third subset indicia 458 formed thereon and a fourth subset packet position 460 having the third set indicia 448 and a fourth subset indicia 462 formed thereon; a fourth set of packet positions including a first subset packet position 464 having a fourth set indicia 466 and a first subset indicia 468 formed thereon, a second subset packet position 470 having the fourth set indicia 466 and a second subset indicia 472 formed thereon, a third subset packet position 474 having the fourth set indicia 466 and a second subset indicia 476 formed thereon and a fourth subset packet position 478 having the fourth set indicia 466 and a fourth subset indicia 480 formed thereon; a fifth set of packet positions including a first subset packet position 482 having a fifth set indicia 484 and a first subset indicia 486 formed thereon, a second subset packet position 488 having the fifth set indicia 484 and a second subset indicia 490 formed thereon, a third subset packet position 492 having the fifth set indicia 484 and a third subset indicia 494 formed thereon and a fourth subset packet position 496 having the fifth set indicia 484 and a fourth subset indicia 498 formed thereon; a sixth set of packet positions including a first subset packet position 500 having a sixth set indicia 502 and a first subset indicia 504 formed thereon, a second subset packet position 506 having the sixth set indicia 502 and a second subset indicia 508 formed thereon, a third subset packet position 510 having the sixth set indicia 502 and a third subset indicia 512 formed thereon and a fourth subset packet position 514 having the sixth set indicia 502 and a fourth subset indicia 516 formed thereon; and a seventh set of packet positions including a first subset packet position 518 having a seventh set indicia 520 and a first subset indicia 522 formed thereon, a second subset packet position 524 having the seventh set indicia 520 and a second subset indicia 526 formed thereon, a third subset packet position 528 having the seventh set indicia 520 and a third subset indicia 530 formed thereon and a fourth subset packet position 532 having the seventh set indicia 520 and a fourth subset indicia 534 formed thereon.

The indicia of the first set through the seventh set of packet compartments may comprise an alpha indicator such as Monday or MON, Tuesday or TUES, Wednesday or WED, Thursday or THUR, Friday or FRI, Saturday or SAT, Sunday or SUN respectively (as shown in FIGS. 6 through 8); a numeric indicator such as 1st, 2nd, 3rd, 4th, 5th, 6th, 7th respectively discrete differentiating color indicators, discrete differentiating braille indicators or other such differentiating indicators.

The indicia of first subset packets through the fourth subset packet compartments 410, 428, 446, 464, 482, 500 and 518; 416, 434, 452, 470, 488, 406 and 524; 420, 438, 456, 474,492, 510 and 528; and 424, 442, 460, 478, 496, 514 and 532 respectively of each set of packet compartments may comprise an alpha indicator such as AM, NN (noon), PM and BT (bedtime) respectively, discrete differentiating color indicators such as green, black, blue and red respectively, discrete differentiating braille indicators or other such differentiating indicators.

In addition, the panel 400 may include a set indicia generally indicated as 534 formed along the upper or lower border or periphey thereof and a subset indicia generally indicated as 536 formed along either side border or periphery thereof.

In use, tablets from bottles or containers are placed into the appropriate packets 10, 28, 46, 64, 82, 100 and 118; 116, 134, 152, 170, 188, 106 and 124; 20, 38, 56, 74, 92, 110 and 128; and 24, 42, 60, 78, 96, 114 and 132 respectively with the sets and subsets in accordance with the required or dictated usage. The sets and subsets or the packets 410, 428, 446, 464, 482, 500 and 518; 416, 434, 452, 470, 488, 506 and 524; 420, 438, 456, 474, 492, 510 and 528; and 424, 442, 460, 478, 496, 514 and 532 respectively are then matched with corresponding indicia such as the packet 410 is attached or placed on the packet position 410 by a tack or other fastening means (not shown) and so forth for all the packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively. Once organized and stored with corresponding indicia as a means or guide to match the packets 10, 28, 46, 64, 82, 100 and 118; 16, 34, 52, 70, 88, 106 and 124; 20, 38, 56, 74, 92, 110 and 128; and 24, 42, 60, 78, 96, 114 and 132 respectively with the corresponding packet positions 410, 428, 446, 464, 482, 500 and 518; 416, 434, 452, 470, 488, 506 and 524; 420, 438, 456, 474, 492, 510 and 528; and 424, 442, 460, 478, 496, 514 and 532 respectively, the system will provide a convenient and reliable means for dispensing tablets at the appropriate time on the appropriate day or date.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A system to organize, store and dispense a plurality of tablets in a predetermined therapeutic regime comprising a plurality of sets of separate packets corresponding to the days of the week configured to store at least one tablet therein wherein each said set of separate packets comprises a subset of the packets corresponding to the time of day for each corresponding day and a packet organizer to separately arrange said sets and subsets of packets sequentially by day and time of day for each corresponding day for selectively dispensing and consumption of the appropriate tablet or tablets at the proper time and day wherein said packet organizer comprises a tray including a first set of open packet compartments, a second set of open packet compartments, a third set set of open packet compartments, a fourth set of open packet compartments, a fifth set of open packet compartments, a sixth set of open packet compartments and a seventh set of open packet compartments; each said set of open packet compartments corresponding to a day of the week, said first set of packet compartments including a first subset packet compartment having a first set indicia and a first subset indicia formed thereon and a second subset packet compartment having the first set indicia and a second subset indicia formed thereon; said second set of packet compartments including a first subset packet compartment having a second set indicia and the first subset indicia formed thereon and a second subset packet compartment having the second set indicia and the second subset indicia formed thereon; said third set of packet compartments including a first subset packet compartment having a third set indicia and the first subset indicia formed thereon and a second subset packet compartment having the third set indicia and the second subset indicia formed thereon; said fourth set of packet compartments including a first subset packet compartment having the fourth set indicia and a first subset indicia formed thereon and a second subset packet compartment having the fourth set indicia and the second subset indicia formed thereon; said fifth set of packet compartments including a first subset packet compartment having a fifth set indicia and the first subset indicia formed thereon and a second subset packet compartment having the fifth set indicia and the second subset indicia formed thereon, said sixth set of packet compartments including a first subset packet compartment having a sixth set indicia and the first subset indicia formed thereon and a second subset packet compartment having the sixth set indicia and the second subset indicia formed thereon; and said seventh set of packet compartments including a first subset packet compartment having the seventh set indicia and the first subset indicia formed thereon and a second subset packet compartment having the seventh set indicia and the second subset indicia formed thereon and wherein said plurality of sets of separate packets comprises a first set of individual packets including a first subset packet having a first set indicia and a first subset indicia formed thereon and a second subset packet having the first set indicia and a second subset indicia formed thereon, a second set of individual packets including a first subset packet having a second set indicia and the first subset indicia formed thereon and a second subset packet having the second set indicia and the second subset indicia formed thereon, a third set of individual packet including a first subset packet having a third set indicia and the first subset indicia and a second subset packet having the third set indicia and the second subset indicia formed thereon, a fourth set of individual packets including a first subset packet having a fourth set indicia and the first subset indicia formed thereon and the second subset packet having the fourth set indicia and the second subset indicia formed thereon, a fifth set of individual packets including a first subset packet having a fifth set indicia and the first subset indicia formed thereon and a second subset packet having the fifth set indicia and the second subset indicia formed thereon, a sixth set of individual packets including a first subset packet having a sixth subset indicia and the first subset indicia formed thereon and a second subset packet having the sixth set indicia and the second subset indicia formed thereon, and a seventh set of individual packets including a first subset packet having a seventh subset indicia and the first subset indicia formed thereon and a second subset packet having the seventh set indicia and the second subset indicia formed thereon whereby said individual packets are at least partially disposed in said open compartments with corresponding indicia and extending outwardly therefrom to facilitate random selective removal therefrom.

2. A system to organize, store and dispense a plurality of tablets in a predetermined therapeutic regime comprising a plurality of sets of separate packets corresponding to the days of the week configured to store at least one tablet therein wherein each said set of separate packets comprises a subset of the packets corresponding to the time of day for each corresponding day and a packet organizer to separately arrange said sets and subsets of packets sequentially by day and time of day for each corresponding day for selectively dispensing and consumption of the appropriate tablet or tablets at the proper time and day wherein said packet organizer comprises a panel having a plurality of packet positions formed in columns and rows to receive said plurality of sets of separate packets thereon, said plurality of packet positions comprises a first set of packet positions, a second set of packet positions, a third set of packet positions, a fourth set of packet positions, a fifth set of packet positions, a sixth set of packet positions and a seventh set of packet positions, each said set of packet positions corresponding to a day of the week or separate date, said first set of packet positions includes a first subset packet position having a first set indicia and a first subset indicia formed thereon and a second subset packet position having the first set indicia and a second subset indicia formed thereon; a second set of packet positions includes a first subset packet position having a second set indicia and the first subset indicia formed thereon and a second subset packet position having the second set indicia and the second subset indicia formed thereon; a third set of packet positions includes a first subset packet position having a third set indicia and the first subset indicia formed thereon and a second subset packet position having the third set indicia and the second subset indicia formed thereon; a fourth set of packet positions includes a first subset packet position having a fourth set indicia and the first subset indicia formed thereon and a second subset packet position having the fourth set indicia and a second subset indicia formed thereon; a fifth set of packet positions includes a first subset packet position having a fifth set indicia and the first subset indicia formed thereon and a second subset packet position having the fifth set indicia and the second subset indicia formed thereon; a sixth set of packet positions includes a first subset packet position having a sixth set indicia and the first subset indicia formed thereon and a second subset packet position having the sixth set indicia and the second subset indicia formed thereon; a seventh set of packet positions includes a first subset packet position having a seventh set indicia and the first subset indicia formed thereon and a second subset packet position having the seventh set indicia and the second subset indicia formed thereon; said plurality of sets of separate packets comprises a first set of packets including a first subset packet having a first set indicia and a first subset indicia formed thereon and a second subset packet having the first set indicia and a second subset indicia formed thereon, a second set of packets including a first subset packet having a second set indicia and the first subset indicia formed thereon and a second subset packet having the second set indicia and the second subset indicia formed thereon, a third set of packets including a first subset packet having a third set indicia and the first subset indicia formed thereon and a second subset packet having the third set indicia and the second subset indicia formed thereon, a third set of packets including a first subset packet having a third set indicia and the first subset indicia formed thereon and a second subset packet having the third set indicia and the second subset indicia formed thereon, a fourth set of packets including a first subset packet having a fourth set indicia and the first subset indicia formed thereon and a second subset packet having the fourth set indicia and the second subset indicia formed thereon, a fifth set of packets including a first subset packet having a fifth set indicia and the first subset indicia formed thereon and a second subset packet having the fifth set indicia and the second subset indicia formed thereon, a sixth set of packets including a first subset packet having a sixth set indicia and the first subset indicia formed thereon and a second subset packet having the sixth set indicia and the second subset indicia formed thereon, a seventh set of packets including a first subset packet having a seventh set indicia and the first subset indicia formed thereon and a second subset packet having the seventh set indicia and the second subset indicia formed thereon.

3. A system to organize, store and dispense a plurality of tablets in a predetermined therapeutic regime comprising a plurality of sets of separate packets corresponding to at least two days of the week configured to store at least one tablet therein wherein each said set of separate packets comprises a subset of the packets corresponding to the time of day for each corresponding day and a packet organizer to separately arrange said sets and subsets of packets sequentially by day and time of day for each corresponding day for selectively dispensing and consumption of the appropriate tablet or tablets at the proper time and day wherein said packet organizer comprises a tray including a first set of open packet compartments, and a second set of open packet compartments, each said set of open packet compartments corresponding to a day of the week, said first set of packet compartments including a first subset packet compartment having a first set indicia and a first subset indicia formed thereon and a second subset packet compartment having the first set indicia and a second subset indicia formed thereon; said second set of packet compartments including a first subset packet compartment having a second set indicia and the first subset indicia formed thereon and a second subset packet compartment having the second set indicia and the second subset indicia formed thereon; and wherein said plurality of sets of separate packets comprises a first set of individual packets including a first subset packet having a first set indicia and a first subset indicia formed thereon and a second subset packet having the first indicia and a second subset indicia formed thereon and a second set of individual packets including a first subset packet having a second set indicia and the first subset indicia formed thereon and a second subset packet having the second set indicia and the second subset indicia formed thereon whereby said individual packets are partially disposed in said open compartments with corresponding indicia and extending outwardly therefrom to facilitate random selective removal therefrom.

4. A system to organize, store and dispense a plurality of tablets in a predetermined therapeutic regime comprising a plurality of sets of separate packets corresponding to at least two days of the week configured to store at least one tablet therein wherein each said set of separate packets comprises a subset of the packets corresponding to the time of day for each corresponding day and a packet organizer to separately arrange said sets and subsets of packets sequentially by day and time of day for each corresponding day for selectively dispensing and consumption of the appropriate tablet or tablets at the proper time and day wherein said packet organizer comprises a panel having a plurality of packet positions formed in columns and rows to receive said plurality of sets of separate packets thereon, said plurality of packet positions comprises a first set of packet positions and a second set of packet positions, said first set of packet positions includes a first subset packet position having a first set indicia and a first subset indicia formed thereon and a second subset packet position having the first set indicia and a second subset indicia formed thereon; a second set of packet positions includes a first subset packet position having a second set indicia and the first subset indicia formed thereon and a second subset packet position having the second set indicia and the second subset indicia formed thereon; said plurality of sets of separate packets comprises a first set of packets including a first subset packet having a first set indicia and a first subset indicia formed thereon and a second subset packet having the first set indicia and a second subset indicia formed thereon, a second set of packets including a first subset packet having a second set indicia and the first subset indicia formed thereon and a second subset packet having the second set indicia and the second subset indicia formed thereon.

* * * * *